US006112931A

United States Patent [19]

Booth et al.

[11] Patent Number: 6,112,931

[45] Date of Patent: Sep. 5, 2000

[54] BLAST ATTENUATING CONTAINERS

[75] Inventors: Ian A. Booth, Fleet; David H. Atton, Ipswich; Robert W. Ince, Swindon; Stephanie M. Hickford, Lowton St. Lukes, Near Warrington, all of United Kingdom

[73] Assignee: Royal Ordnance PLC, Chorley, United Kingdom

[21] Appl. No.: 08/325,361

[22] PCT Filed: Apr. 29, 1993

[86] PCT No.: PCT/GB93/00893

§ 371 Date: Dec. 12, 1994

§ 102(e) Date: Dec. 12, 1994

[87] PCT Pub. No.: WO93/22223

PCT Pub. Date: Nov. 11, 1993

[30] Foreign Application Priority Data

Apr. 29, 1992 [GB] United Kingdom ..... 9209242

[51] Int. Cl.[7] ..... B65D 88/14

[52] U.S. Cl. ..... 220/88.1; 220/1.5; 220/683

[58] Field of Search ..... 220/88.1, 1.5, 220/683, 685, 444

[56] References Cited

U.S. PATENT DOCUMENTS

| | | | |
|---|---|---|---|
| 2,489,670 | 11/1949 | Powell, Jr. | 220/683 X |
| 3,716,259 | 2/1973 | Weill et al. | 220/683 X |
| 3,989,157 | 11/1976 | Veenema | 220/683 X |
| 4,115,655 | 9/1978 | Prentice | 220/683 X |
| 4,162,341 | 7/1979 | Norton | 220/444 X |
| 4,325,488 | 4/1982 | Ketner | 220/683 X |
| 4,347,941 | 9/1982 | Johansson et al. | 220/1.5 X |
| 4,558,797 | 12/1985 | Mitchell | 220/1.5 X |
| 4,860,912 | 8/1989 | Kupersmit | 220/1.5 |
| 4,884,715 | 12/1989 | Pohlmann | 220/683 |

*Primary Examiner*—Steven Pollard
*Attorney, Agent, or Firm*—Nixon & Vanderhye P.C.

[57] ABSTRACT

An aircraft cargo container adapted to provide blast attenuation in the event of an explosion within the container comprises panels (2,3) of blast resistant material joined together by joint means (4,5) which are adapted to provide a relatively rigid joint udner normal handling conditions, but which provide a relatively flexible hinged joint capable of transmitting tensile loads between the panels under blast conditions. Additional reinforcement may be provided by a lattice of high tensile strength straps 6 substantially surrounding the container.

17 Claims, 7 Drawing Sheets

Fig. 5.
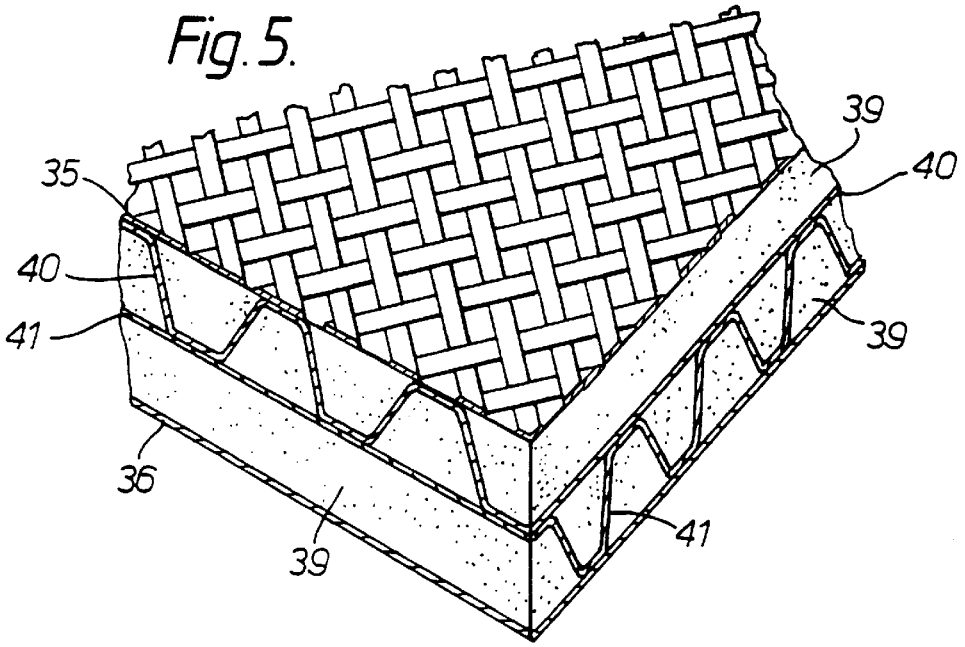
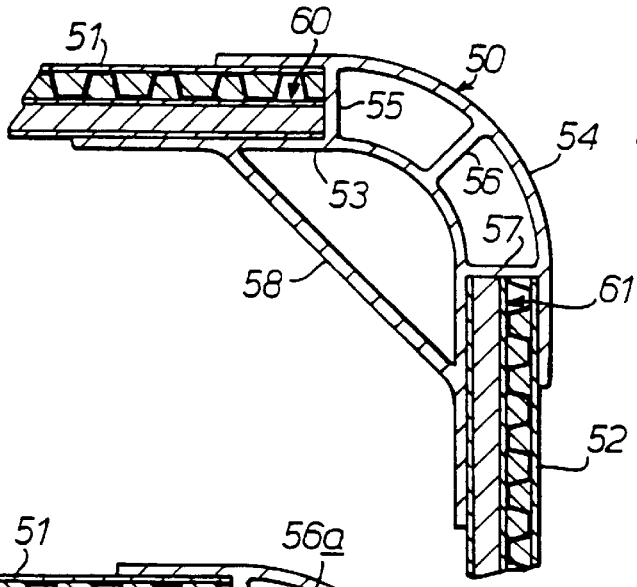
Fig. 6.
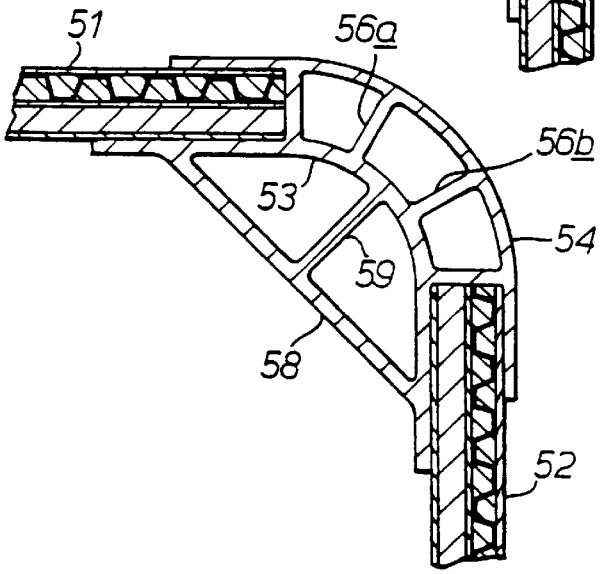
Fig. 7.

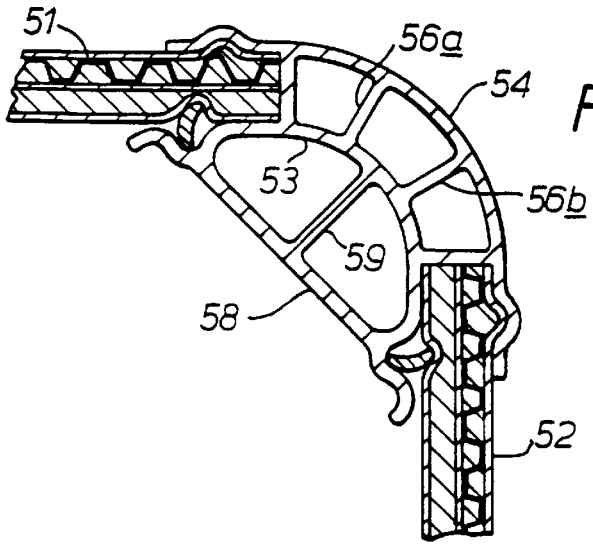
Fig. 8.
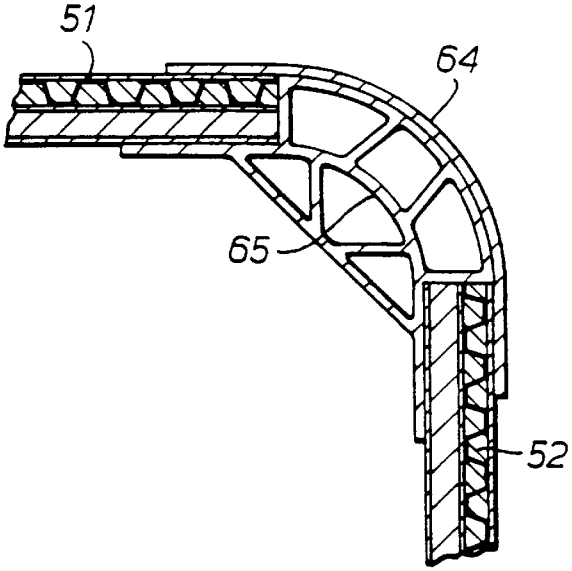
Fig. 9.
Fig. 10.
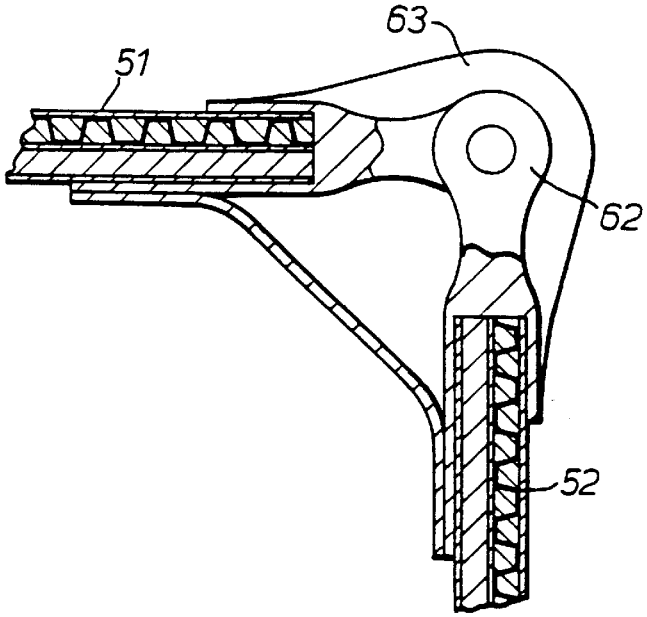

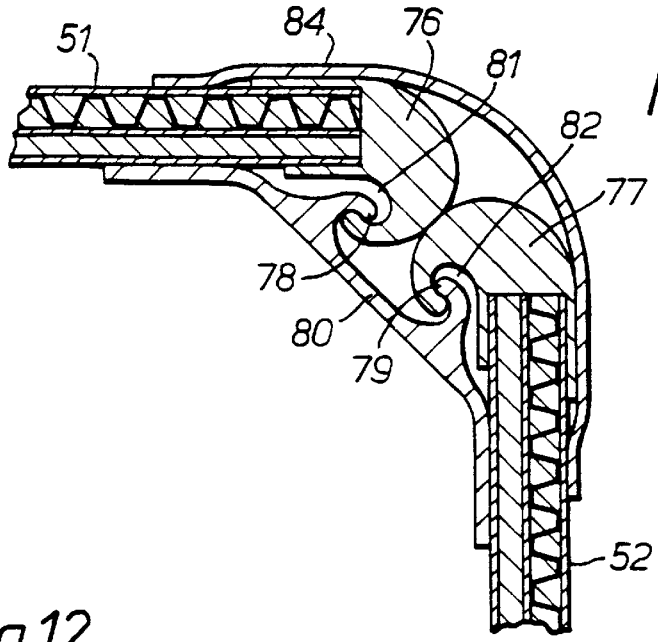
Fig.11.
Fig.12.
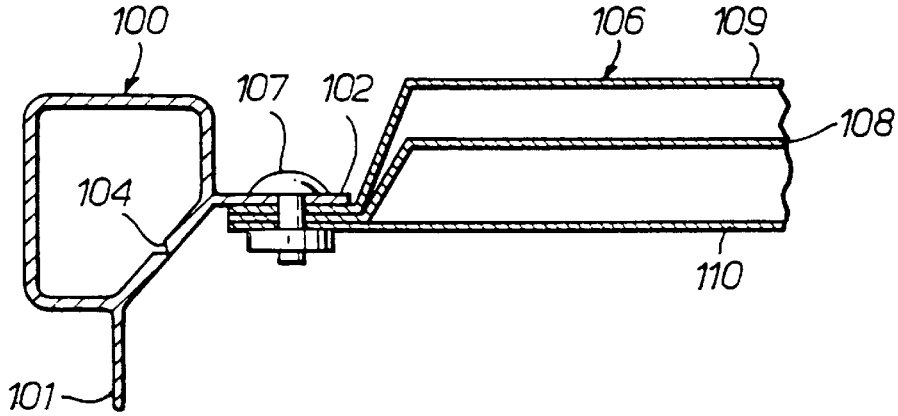
Fig.13.
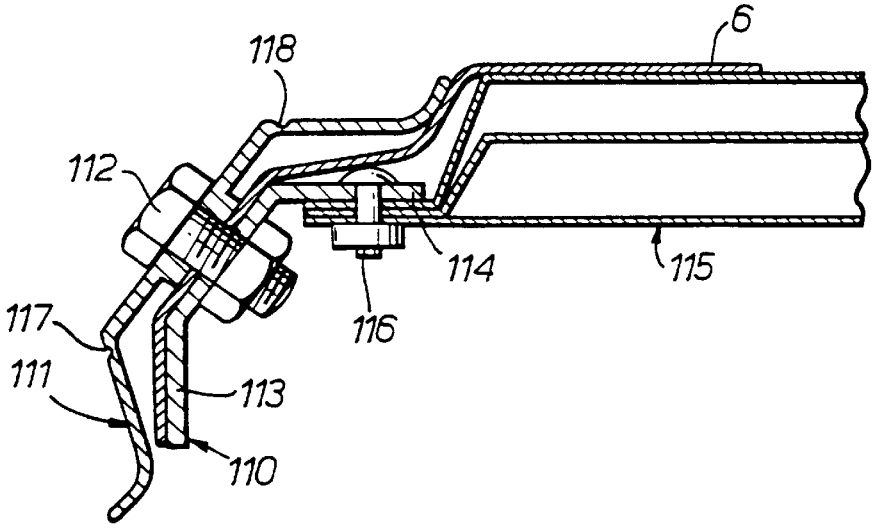

BLAST ATTENUATING CONTAINERS

BACKGROUND OF THE INVENTION

1. Field of the Invention

This invention relates to blast attenuating containers such as aircraft luggage containers.

2. Discussion of Prior Art

It is known to use blast attenuating materials in the construction of aircraft luggage containers in order to reduce the effects of the blast from a detonating or exploding device within the container. Indeed, Applicant's International Patent Application No. PCT/GB90/01724 (International Publication No. WO91/07337) describes such a container using blast attenuating materials in accordance with Applicant's co-pending International Patent Application No.PCT/GB90/01723 (International Publication No. WO91/07275). The container described in the first-mentioned patent application is preferentially weakened to ensure that the blast caused by an explosive device within the container is vented in a predetermined direction in order to limit the damage caused.

An alternative approach, which relies to some extent on the expectation that only relatively small-scale explosive devices will escape detection by routine security screening procedures, is to endeavour to substantially contain the blast, and fragments from it, within the container.

In either case, it is important to ensure that the parts of the container, if any, which are not preferentially weakened retain a degree of structural integrity throughout the blast in order to perform the desired blast absorbing and attenuating function.

Most aircraft containers in current use are of standardised construction, conforming to one or other of the International Air Transport Association's (IATA) specifications for Unit Load Devices. Such containers typically comprise a number of panels assembled on a rigid base and joined at their edges to form an enclosure. Whilst capable of withstanding normal handling loads, the panels and joints are not capable of effectively containing or attenuating a blast from an explosive device.

SUMMARY OF THE INVENTION

According to the present invention, a blast attenuating container comprises a number of panels, at least one of which has blast attenuating properties, the panels being joined together to form an enclosure by joint means which provide a relatively rigid joint between the panels under normal handling loads, but which provide a relatively flexible hinged joint capable of transmitting tensile loads between the panels under blast conditions.

The invention derives from the recognition that in order to effectively attenuate and hopefully contain the blast from a bomb detonating within the enclosure, it is important that the container, at least in those parts which are not preferentially weakened, substantially retains its structural integrity during the blast to the extent that no major disintegration or rupture occurs that would allow significant blast pressure to escape.

Conventional joints between container panels necessary to provide the desired rigid structure for normal handling would either fracture or cause the panel to tear or rupture adjacent the joints under blast conditions. In a container in accordance with the present invention, by ensuring that the joint means behave as flexibly hinged tensile load-bearing joints between the panels under such blast conditions, the risk of rupture is considerably reduced thereby also enabling the blast attenuating properties of the panels to be fully effective.

The joint means, which will normally comprise a combination of edge and corner joints, may be of two different materials, one having the desired stiffness to provide a rigid joint under normal handling conditions but which ruptures or fractures under blast conditions, and the other material having the desired flexible and tensile load-bearing properties.

Alternatively, the joint means may comprise a single material which either inherently exhibits the necessary properties, or whose rigidity under normal handling conditions is provided by a structural element which deforms or ruptures under blast conditions to leave a flexible tensile load-bearing joint element.

Where the joint means comprise a combination of edge and corner joints, these are preferably connected to one another in a manner which provides a stiff joint between them having the desired rigidity under normal handling conditions, but which behaves as a flexible tensile-load bearing joint under blast conditions thereby further reducing the risk of disintegration.

To further improve the blast attenuating properties of the container, it may be partially completely enclosed within a lattice of high tensile strength straps which function in the manner of a 'string bag' under load conditions again with a view to reducing the risk of disintegration of the blast containing portions of the container.

BRIEF DESCRIPTION OF THE DRAWINGS

The invention will now be described in greater detail by of example only with reference to the accompanying drawings, of which:

FIG. 5 shows a schematic sectional view of part of the base of the container;

FIGS. 6 to 13 show cross-sectional views through different forms of panel edge joints for use in the container;

DETAILED DISCUSSION OF PREFERRED EMBODIMENT

Figure 1:
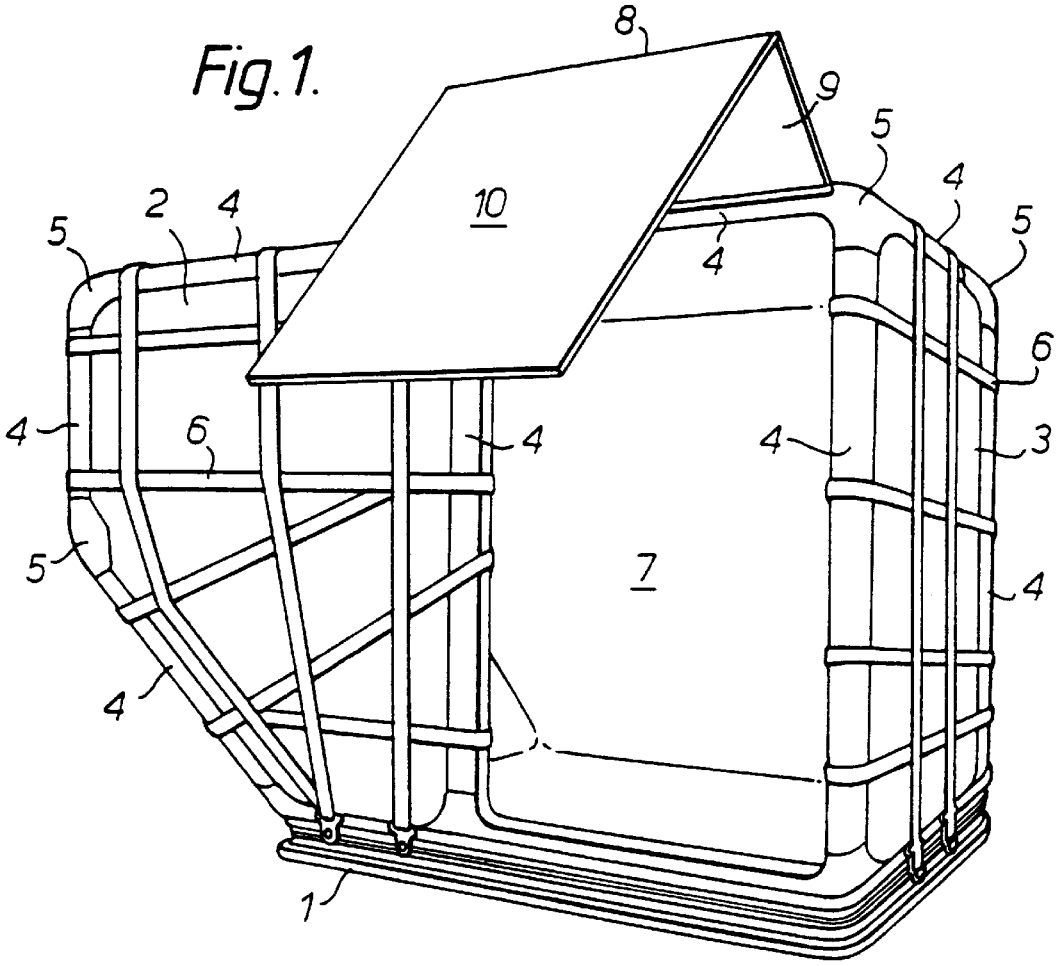
FIG. 1 is a perspective side elevation of an embodiment of the present invention in the form of an aircraft luggage container.

Referring to the drawings, FIG. 1 shows an aircraft luggage container configured and constructed of lightweight materials to comply with the requirements of the International Air Transport Association's (IATA) Unit Load Device Technical Manual, and essentially comprising a strong rigid base 1, the sides, ends and top of the container being provided by panels of blast attenuating material (of which only one side panel 2 and one end panel 3 can be seen in FIG. 1) which are assembled on the base 1 and joined together by edge joints 4 and corner joints 5 to form a substantially rigid enclosure.

A loading entrance 7 is provided on one side of the container which entrance is closed by a door 8 comprising first and second door sections 9, 10. The first upper door section 9 is hinged along its top edge to one of the container edge joints 4, and along its lower edge to the second door section 10.

The door sections 9, 10 are formed of the same blast attenuating materials as the blast attenuating panels 2, 3 of the container which will be described in more detail below, and is provided with suitable door closure means (not shown) which are capable of transmitting tensile loads between the door and the base and edge joints surrounding the loading entrance.

Except for the base 1 and loading entrance 7, the container is surrounded by a lattice of woven straps 6 of high tensile strength which are anchored at various points around the base and loading entrance 7 as shown. The straps 6 may additionally be secured across the door 8 after it is closed to provide further support both during normal handling and under blast conditions.

Figure 2:
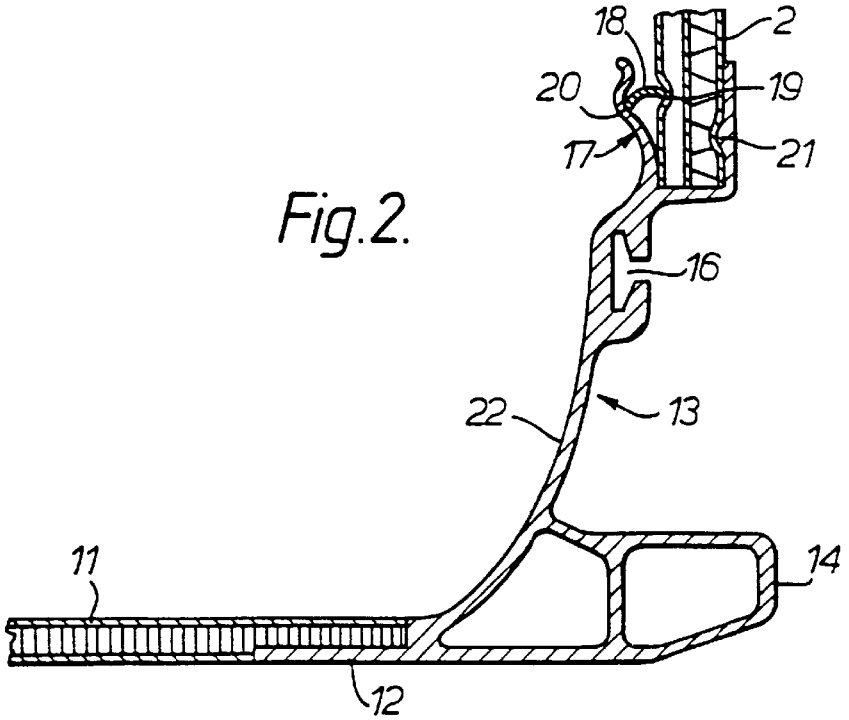
FIG. 2 is a sectional view through part of the base of the container.

Referring now to FIG. 2, the base 1 comprises a substantially rectangular rigid composite panel 11 adhesively bonded around its edges to a flange 12 projecting inwardly from a surrounding frame 13 of extruded aluminium. The frame 13 is also formed with an outwardly projecting flange 14 adapted to interlock with industry standard floor retaining means in an aircraft luggage compartment, and a recessed channel 16 which provides external anchor points for the straps 6.

The upper free edge of the frame 13 is formed with a channel 17 into which the lower edges of the blast attenuating side and end panels 2, 3 of the container are received. These panels 2, 3 may either be positively retained within the channel solely by the straps 6, although preferably they are secured either by adhesive bonding or, as shown, by mechanical retaining means. In this embodiment, the mechanical retaining means comprises a 'C'—section resilient spring strip 18 press-fitted between cooperating recesses 19, 20 along the lower inside edge of the panel 2 and the adjacent internal surface of the channel 17 respectively. The other internal surface of the channel 17 is formed with a ridge 21 to provide a more secure friction fit for the panel 2 within the channel 17. In use, application of tensile loading between the panel 2 and the base 1 tends to cause the 'C'—section spring strip 18 to open and thus lock the panel to more securely in the channel 17. Blast pressure acting on the inner lip of the channel 17 provides increased grip under blast conditions.

The portion 22 of the frame 13 which extends between the flange 12 and the channel 17 is of curved cross-section presenting a concave internal corner around the base of the container which serves to deflect the blast by avoiding the concentration of pressure that would otherwise occur with an angular corner.

Figure 3:
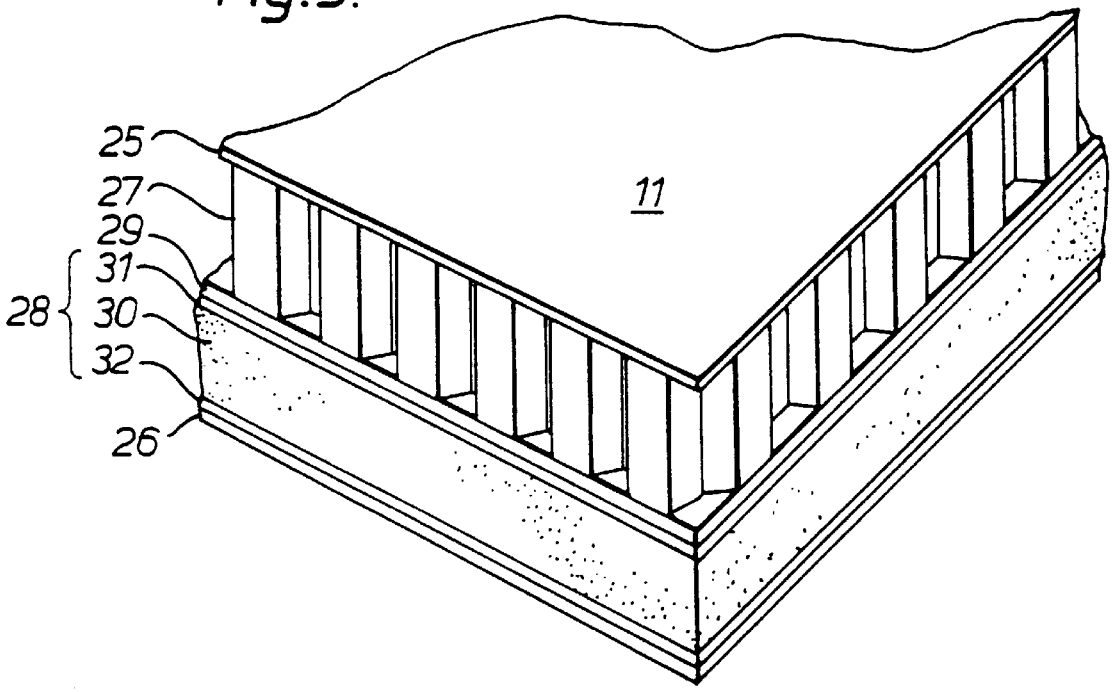
FIGS. 3 and 4 show schematic sectional view of two different forms of blast attenuating panel for use in the aircraft luggage container.

With reference now to FIG. 3, the base panel 11 of the base 1, providing as it does the load-bearing floor of the container, is of lightweight composite multi-layer rigid construction designed to have sufficient strength and rigidity to withstand not only the considerable loads experienced during normal use, but also to contain and prevent the transmission of blast pressures and fragments in the event of an explosion occurring within the container. It therefore differs from the side and end panels 2, 3 in that it is blast reflecting rather than blast absorbing or blast attenuating.

The upper and lower surfaces of the panel 1 are provided by layers 25, 26 of aluminium, or 'E'—glass impregnated with phenolic resin, approximately 2 mm thick. Sandwiched between the two layers 25, 26 is an upper honeycomb layer 27 formed either of extruded aluminium or phenolic resin-impregnated paper such as Nomex (RTM) which is approximately 5 mm thick, and a lower layer 28 of armour plating comprising a layer 30 of aluminium oxide ceramic approximately 5 mm thick sandwiched between thin rubber sheets 31, 32. Between the honeycomb layer 27 and the armour plating layer 28 is a 2 mm thick layer of aluminium, or 'E'—glass impregnated with phenolic resin, similar to the outer layers 25, 26. The various layers of the sandwich materials comprising the panel 11 are adhesively bonded together using appropriate fire resistant phenolic resins.

The base of the container may be additionally provided with a false floor (not shown) defining between it and the floor panel 11 a venting cavity. In such an embodiment, the false floor is preferentially weakened in selected areas such that under blast conditions these areas are ruptured to provide passages through which blast gases can vent into the venting cavity thereby reducing the internal pressure during an explosion within the container.

The upper and lower surface layers 25, 26 provide a strong impact resistant skin for the panel 11, the honeycomb layer 27 imparts a high degree of rigidity whilst the armour plating layer 28 serves primarily to prevent the transmission of blast fragments through the floor of the container.

The blast attenuating side, end and top panels 2, 3 of the container maybe of any suitable lightweight blast attentuating material, although they are preferably formed of a composite blast attenuating material in accordance with the Applicant's International Patent Application No.PCT/GB90/01723 (International Publication No.WO91/07275). Examples of suitable materials designed specifically for use in the present application are shown in FIGS. 4 and 5.

Figure 4:
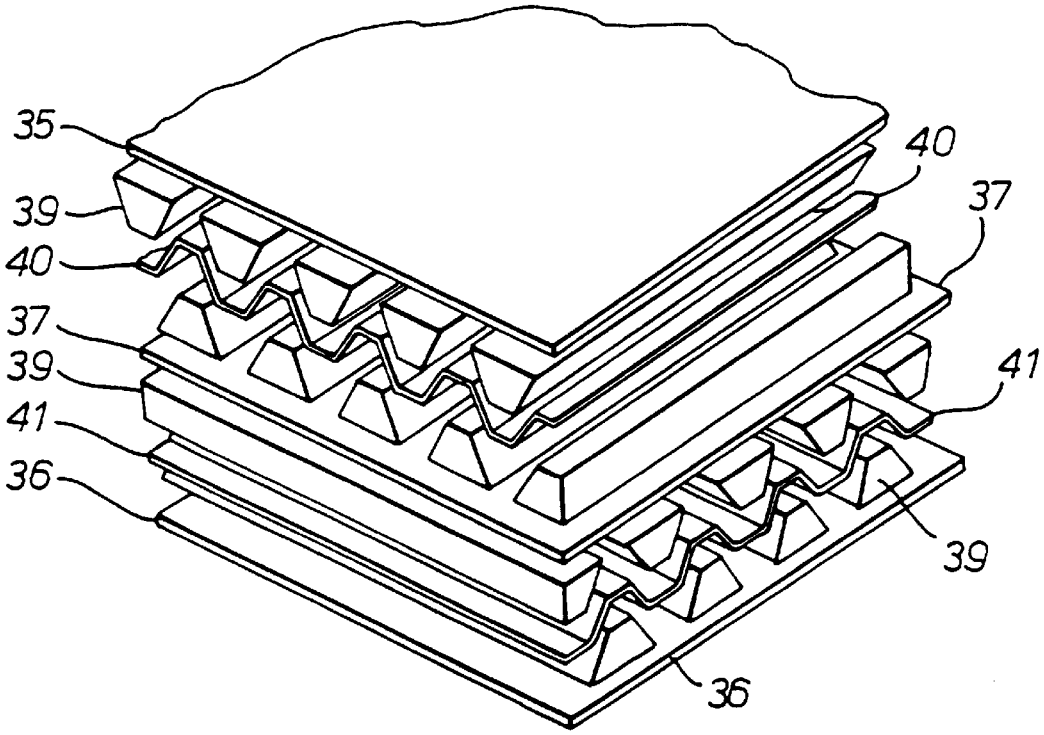

The material shown in FIG. 4 comprises outer layers 35, 36, of impact resistant material and sandwiched between each of these layers 35, 36 and intermediate layer 37 are slabs 39 of lightweight foamed or cellular plastics material supported along, and effectively embedding therein, the corrugations of a respective corrugated support layer 40, 41. The corrugations of the support layer 40, 41 and of the slabs 39 in each of the two main layers of the sandwich are arranged orthogonal to one another to provide, in aggregate, a reticulated or cellular crumple pattern under blast conditions.

The various layers of the sandwich structure are adhesively bonded together using a fire resistant phenolic resin to provide a unitary structure having an overall thickness of approximately 35 mm, the thickness of each of the layers 35, 36, 37 being approximately 1.5mm and the depth of each of the slabs 39 approximately 15mm.

The layers 35, 36, 37 which are air permeable under blast conditions are formed of a glass fibre reinforced material such as woven or stitched 'S' or 'E' glass fibres impregnated with phenolic resin. Such material is advantageously non-permeable to air (and water) under normal handling conditions but becomes porous and permeable under blast conditions when the resin is blown from the interstitial holes in the glass fibre structure. In order to ensure that the interstices between the fibres are filled with resin, a backing tissue (not shown) may be inserted as part of the skin matrix for layers 35, 36, 37.

The slabs 39 are formed of a foamed phenolic resin which is highly blast-absorbent as it is crushed to powder under blast conditions. The corrugated layers 40, 41 are formed of stitched 'E' glass fibres impregnated with phenolic resin to provide a degree of stiffness which reinforces the foamed slabs 39 to provide increased energy absorption as they are compressed under blast conditions.

The material shown in FIG. 5 is generally similar to that shown in FIG. 4 (with corresponding parts bearing the same reference numbers) except that the central layer 37 of impact resistant material has been omitted, and the foamed energy-absorbent slabs 39 are formed in situ rather than being pre-formed as in the FIG. 4 embodiment. In a further embodiment, not shown, the corrugated reinforcing layers 40, 41 are of dimpled rather than corrugated construction.

In addition to their inherent blast absorbing properties, the materials described with reference to FIGS. 4 and 5 also display high tensile strength as well as a high coefficient of elongation before failure which is primarily imparted by the corrugated (or dimpled) reinforcing layers 40, 41.

In order to provide an effective blast attenuating structure, the blast attenuating panels of the container must be joined together by suitable joints. In accordance with the present invention, these edge joints, which are referenced 4 in FIG. 1, have relatively high stiffness to provide a substantially rigid structure under normal handling loads, but essentially behave as flexible hinges capable of transmitting high tensile loads under blast conditions.

A number of suitable edge joints will now be described with reference to FIGS. 6 to 13. Referring first to FIG. 6, the edge joint 50 shown in cross-section comprises an elongate structure of composite material designed to connect the edges of two adjacent blast attenuating panels 51, 52 of the container at right angles to one another. The joint 50 essentially comprises inner and outer parallel webs of material 53, 54, the inner web 53 being substantially wider than the outer web 54, and the two webs being folded through 90° and are held apart by radially extending spacers 55, 56, 57.

Additionally, the joint is formed with an integral deflector plate 58 which is provided by a third web extending across the right angle bend of the inner surface of the folded inner web 53. The free edges of the two webs 53, 54 define, in conjunction with the radial spacers 55, 57, respective channels 60, 61 adapted to receive the edges of the panels 51, 52 which are adhesively bonded therein. The greater widths of the inner web provides it with an increased area of bonding contact with each of the panels 51, 52.

The joint is formed of a composite material capable of transmitting tensile loads both longitudinally and transversely, and comprises a fibre reinforced plastics composite having good rigidity at normal handling loads under which the deflector plate 58 provides additional rigidity and support.

However, under blast conditions, the deflector plate 58 serves initially to deflect the blast away from the corner thus avoiding concentrations of blast pressure which would otherwise occur at this point, and subsequently yields to permit the joint to flex whilst transmitting tensile loads between the adjacent plates 51, 52 as the container tends to adopt a spherical shape under the pressure of the blast. This critical feature of the invention greatly reduces the risk of rupture of either the joint itself or the panels thereby greatly assisting in blast containment.

The edge joint shown in FIG. 7 is similar to that shown in FIG. 6 and corresponding parts bear the same reference numerals. In this embodiment the centre of the deflector plate 58 is spaced from the centre of the folded inner web 53 by a radial spacer 59. Note also that the spacer 56 is replaced by a pair of spacers 56*a*, 56*b* which are thus staggered with respect to the spacer 59. This construction enhances the blast deflecting properties of the deflector plate 58.

In both the joints of FIG. 6 and FIG. 7, the hollow spaces provided between the webs 53, 54 and 58 can be filled with blast absorbent foam or other material to improve blast absorption.

Referring now to FIG. 8, again the construction of this edge joint is substantially identical to that described with reference to FIG. 7 except that the means for connecting the joint to the panels 51, 52 comprises mechanical locking means substantially identical to that described with reference to FIG. 1 for securing the blast attenuating panels of the container to the base 1.

The edge joint shown in FIG. 9, is generally similar in overall construction to that described with reference to FIGS. 6 and 7 except that it is made of two separate components 64, 65, the integral outer web of the main component 65 being supplemented by a separate external component 64 of different material. In addition, the FIG. 9 embodiment shows a different configuration for the spaces between the webs of material forming the main component 65 of the joint.

The main component 65 of the joint shown in FIG. 9 is designed to provide the main longitudinal tensile strength for the joint and is thus formed as a pultruded fibre reinforced plastics composite having longitudinal reinforcing fibres. The external component 64 is formed of a woven or stitched "E" glass fibre mat impregnated with phenolic resin and bonded over the outer surface of the main component 65 and extending into bonded contact with the edges of the two panels 51, 52 and is designed to provide the main transverse tensile strength for the joint under blast conditions.

Again, the handling and blast performance characteristics of the joint are substantially as described with reference to FIGS. 6, 7 and 8.

Referring now to FIG. 10, the joint shown comprises a mechanical hinge 62 coupled to the plates 51 and 52 by adhesive bonding and encased in a composite material 63 which provides the joint's rigidity under normal handling conditions, but which is frangible under blast conditions.

A blast deflector plate 64 is provided across the corner of the joint which is formed of 'E' or 'S' glass fibre reinforced resin which serves not only to prevent concentration of blast pressure in the corner of the container, but also provides additional rigidity to the joint at normal strain rates.

The material of the encasement 63 may be of suitable blast absorbent material such as foamed phenolic resin, and similar material may be used to fill the hollow portions of the joint shown in FIGS. 6 to 9 to provide additional blast absorption.

Referring now to FIG. 11, the joint comprises curved bearing members 76, 77 bonded along the edges of adjacent panels 51, 52 and coupled together by opposed hooked tongues 78, 79 formed on the internal surface of a blast deflector plate 80 which is of high elongation material. The tongues 78, 79 engage within cooperating grooves 81, 82 formed in the bearing members 76, 77 to form a hinged roller joint between the panels 51, 52.

The joint is completed by an external component 64 bonded between the panels 51, 52 in a similar manner to the external component 65 of FIG. 10. The inner voids of the joint may be filled with blast absorbent foam or other material to increase rigidity of the joint under normal handling conditions while providing additional blast absorption properties.

In operation under blast conditions the portion of the deflector plate 80 between the tongues 78, 79 stretches to allow the joint to hinge about the curved bearing members 76, 77 whilst retaining the integrity of the joint.

FIG. 12 shows a further form of joint in accordance with the present invention which is of unitary construction comprising a high-strength aluminium or fibre-reinforced composite extrusion 100 of generally hollow trapezoidal box section formed with fixing flanges 101, 102 along its length. Other cross-sectional configurations, e.g. circular, may similarly be used for the extrusion 100. The face 103 of the box-section extrusion which adjoins the two fixing flanges 101, 102 is preferentially weakened along its length by means of a groove 104.

The fixing flanges 101, 102 are fastened to the edges of blast absorbent panels 106 (only one shown) by means of mechanical fasteners 107. Adhesive bonding may alternatively or additionally be used. The panel 106 is of generally similar construction to those described earlier, e.g. with reference to FIGS. 4 and 5, except that the impact-resistant outer sheets 109, 110 and intermediate reinforcement sheets 108 are brought together at their edges to facilitate their attachment to the fixing flanges 101, 102, of the joint. It will be apparent that a similar construction may also be used in conjunction with some or all of the joints described with reference to FIGS. 6 to 11.

In operation, the joint provides a rigid edge joint for the container under normal handling conditions, but is adapted to rupture along the weakening groove 104 in the event of a blast within the container. In this eventuality, the remaining wall portion of the box section extrusion then provides a flexible tensile load-bearing joint between the adjoining panels.

FIG. 13 shows a further form of joint construction comprising a pair of co-operating channel section extrusions 110, 111 of aluminium or fibre-reinforced composite material which are bolted together at periodic intervals along their length by means of bolts 112. The inner extrusion 110 is, in use, fastened along edge flanges 113, 114 to the edges of blast attenuating panels 115 (only one is shown) by means of mechanical fasteners 116 (as shown) or adhesive bonding or both in the manner described with reference to FIG. 12.

The outer extrusion 111 is formed along its length with a pair of weakening grooves 117, 118 adjacent to the angles of the channel section. Where straps 6 (see FIG. 1) are provided, these pass between the two extrusions 110, 111 so that when the extrusions are bolted together, the straps are tensioned.

In operation, the joint again provides rigidity under normal load handling conditions, but when subject to a blast within the container, the outer extrusion 111 is designed to break along the weakening grooves 117, 118 to provide a flexible tensile load-bearing joint between the adjoining panels 106.

Figure 14:
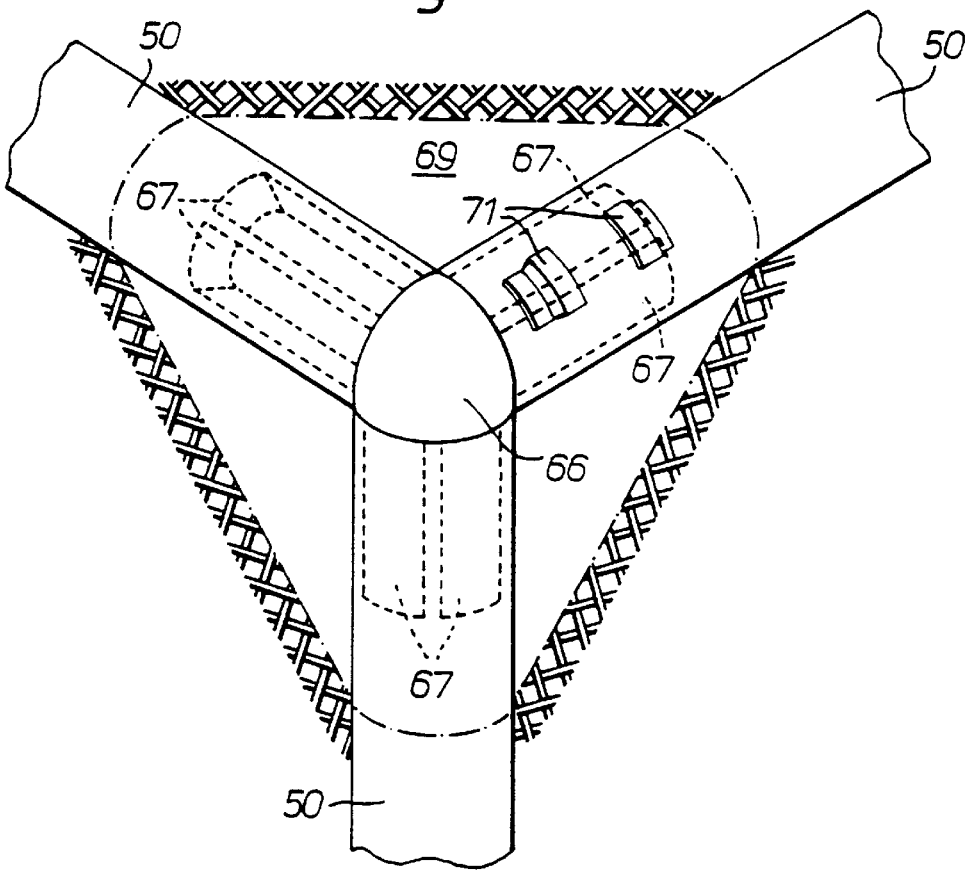
FIGS. 14 and 15 show different forms of corner joint for use in the container.

Referring now to FIG. 14, a corner joint suitable for use in conjunction with the form of edge joint 50 described with reference to FIG. 6 comprises a moulding 66 of composite or other suitable material formed with three pairs of mutually orthogonal projections 67 which are adapted to be adhesively bonded into the hollow spaces defined between the webs 53, 54 of the joint 50 as shown.

The material for the corner joint moulding is selected such as to provide under normal handling conditions, a substantially rigid joint between the three edge joints to which it is connected, but to behave as a relatively flexible hinged joint between them when subjected to loads experienced under blast conditions.

A less rigid material for the corner joint 66 may be chosen where the corner is provided with an external reinforcing corner plate 69 of 'E' or 'S' glass fibre adhesively bonded over the corner joint as shown. Alternatively, or preferably additionally, an internal corner deflector plate (not shown) may also be provided on the interior of each corner joint 66 for blast deflection, and to provide addition reinforcement. This is suitably shaped to match the deflector plates 58 on the adjacent edge joints 50.

In the case of the edge joints described with reference to FIGS. 7, 8 and 9, corner joints for use with these joints will be of generally similar construction to that shown in FIG. 14 but the number and configuration of the projections 67 will obviously be varied to cooperate with the particular configuration of the edge joint used.

Also seen in FIG. 14 on the outer surface of the exterior corner reinforcement plate 69 is a pair of guide brackets 71 for the straps 6 shown in FIG. 1. Similar pairs of brackets may be provided at other positions on the corner joints and at appropriate intervals along the edge joints to ensure positive location of the straps in use.

Figure 15:
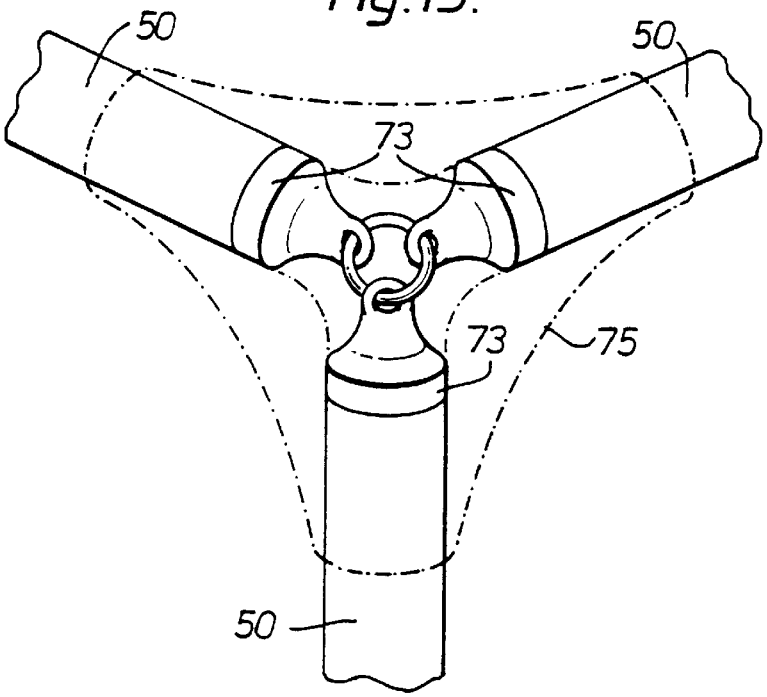

Referring now to FIG. 15, this illustrates an alternative form of corner joint comprising three end fittings 73 which are adhesively bonded into the ends of adjacent edge joints 50 in a manner similar to that described for the corner joint moulding 66 in FIG. 14. The end fittings 73 are each formed with an eye through which a tie ring 74 passes to flexibly couple the three fittings together.

The corner joint thus formed may then be encased within a frangible composite material in a fashion similar to that described with reference to the hinged joint in FIG. 10, and an additional reinforcing plate 75 may be adhesively bonded over the exterior of the joint to provide additional stiffness and protection during handling.

Figure 16:
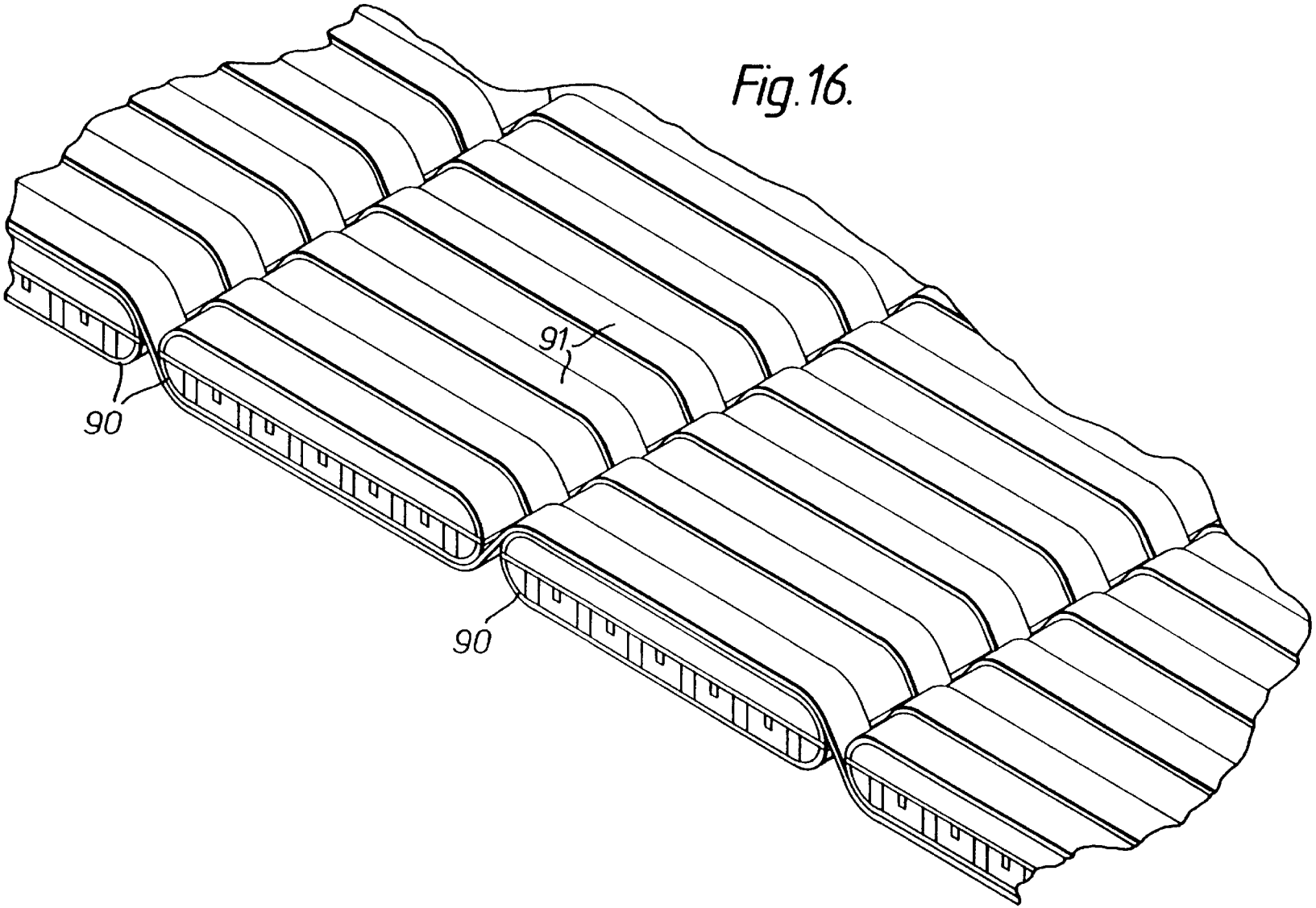
FIG. 16 illustrates an alternative form of door construction for the container.

Referring now to FIG. 16, this shows an alternative form of door construction for the opening 7 of the container of FIG. 1. This comprises a series of slats 90 each comprising an elongate blast attenuating panel of similar construction to the blast attenuating side and end panels 2, 3 of the container described with reference to FIGS. 4 and 5. The slats 90 are interlaced with strips of tape 91 bonded to the slats 90 whilst providing a flexible hinged joint between adjacent slats. The tape is of a woven high-tensile strength material, such as nylon, similar to the straps 6 described with reference to FIG. 1.

The door may simply be suspended as a curtain from the joint 4 at the top of the opening 7 such that it can be opened simply by folding or rolling it upwards. Alternatively it may be mounted in guide channels on either side of the opening 7 whereby it may be opened by an up-and-over sliding action.

Integrity of the container structure over the doorway is ensured by positive location of the door material around the periphery of the loading entrance 7.

The operation of the container in accordance with the invention in suppressing the effects of an explosion within the container will now be described.

The primary purpose of the blast attenuation construction is to substantially attenuate shock waves and pressures generated by an explosion to a level which can be accommodated by the aircraft structures and systems, and also that any fragments escaping from the blast are of low momentum insufficient to cause major damage to the aircraft structure.

When an explosion takes place within the container, there is a very rapid rise in pressure with resultant shock waves. Typically pressures of 200 kPa (30 lb/in$^2$) are not uncommon from a device containing a small amount of plastic explosive.

The blast pressure within the container causes the container structure to deflect and expand towards a spherical shape. In the embodiment described above, the base 1 of the container is rigid and non-attenuating being designed to resist serious damage to the freight floor structure of the aircraft, whilst the blast attenuating panels 2, 3 of the container provide the primary blast attenuating mechanism.

In this connection, as the structure deforms towards a spherical shape, the blast attenuating panels gradually absorb energy by the progressive deformation and collapse of the various panel materials substantially as described in Applicant's co-pending International Patent Application No.PCT/GB 90/01723 referred to above.

The containers and joint means in accordance with the present invention may also be used in conjunction with containers in accordance with co-pending International Patent Application No. PCT/GB/92/02379 which describes additional blast absorption mechanisms for use in aircraft containers.

In accordance with the invention, the edge and corner joints of the container serve to hold the blast attenuating panels together whilst allowing the structure to freely deform towards a spherical shape thereby enabling the blast attenuating properties of the panels to be fully effective. The longer the panels can be held together and deform and expand without rupture the greater will be the attenuation achieved.

In this regard the corrugated layers 40, 41 of the blast attenuating panel materials shown in FIGS. 4 and 5 allow high energy absorbing deformation and expansion of the material before rupture. The orientation of the corrugation in layers 40, 41 may be linear as shown or in the form of concentric rings to allow ballooning of the panel when subjected to blast energy.

The outer straps 6, where provided, assist blast attenuation by providing a tensile resistance to the expansion and deformation of the container structure thus absorbing further energy and preventing or delaying disintegration of the container. Although the straps are shown in FIG. 1 anchored to the base 1, they may alternatively be wound around the entire periphery of the container in any or all axes and may be permanently bonded to or integrally formed with the container structure during production.

We claim:

1. A blast attenuating container comprising:

number of panels, at least one of which has blast attenuating properties, the panels being joined together to form an enclosure by joint means for providing a relatively rigid joint between joined panels under normal handling loads and for providing a relatively flexible hinged joint capable of transmitting tensile loads between joined panels under blast conditions.

2. A blast attenuating container as claimed in claim 1, wherein the joint means comprise:

first and second components, the first component having sufficient stiffness to provide a rigid joint under normal handling conditions, but which is adapted to rupture or fracture under blast conditions, but which is adapted to rupture or fracture under blast conditions, and the second component providing a flexible tensile load-bearing joint between panels following rupture or fracture of the first component.

3. A blast attenuating container as claimed in claim 2, wherein the second component (62) of the joint is encased within the first component (63).

4. A blast attenuating container as claimed in claim 2, wherein the second component (62) comprises respective hinge members rigidly connected to the edges and/or corners of the panels (51,52) and mechanically hinged to one another.

5. A blast attenuating container as claimed in claim 1, wherein the joint means (50) is formed of a material which is rigid under normal handling conditions, but which is rupturable or deformable under blast conditions to provide a flexible tensile load-bearing joint between the panels.

6. A blast attenuating container as claimed in claim 5, wherein the joint means is formed of aluminium or fibre reinforced plastics composite material.

7. A blast attenuating container as claimed in claim 5, wherein the edge joint means (50) comprise a pair of parallel webs (53,54) angled to provide a corner between adjoining panels and spaced apart to provide a gap between them, the edges of each web being bonded and/or mechanically fastened to the edges of the panels (51,52).

8. A blast attenuating container as claimed in claim 7, wherein the angled inner web (53) of the joint means (50) if subtended by a third web (58) which provides rigidity for the joint under normal loads but which is adapted to rupture under blast conditions such that the angled pair of webs (53, 54) provides a flexible tensile load bearing joint between the panels.

9. A blast attenuating container as claimed in claim 7, wherein the space between the webs (53, 54, 58) is filled with blast absorbent material.

10. A blast attenuating container as claimed in claim 5, wherein the edge joint means (100) comprise an elongate member of hollow section formed externally along its length with means (101, 102) for attachment to respective panels (106) of the container, a region (103,104) of the hollow section member between the said attachment means being preferentially weakened along the length of the joint such that it ruptures under blast conditions, the remaining wall section providing a flexible tensile load bearing joint between the panels.

11. A blast attenuating container as claimed in claim 1, wherein the panel(s) having the blast attenuating properties comprise one or more layers (39) of lightweight crushable or deformable foamed or cellular material sandwiched between layers of impact resistant material (35, 36, 37).

12. A blast attenuating container as claimed in claim 11, wherein said layers of lightweight foamed or cellular material (39) have embedded therein corrugated or dimpled reinforcing sheet material (40, 41) adapted to crumple under blast conditions to provide additional blast energy absorption.

13. A blast attenuating container as claimed in claim 11 wherein said layers of impact resistant material (35, 36, 37) are substantially impermeable to air under normal handling conditions, but become air permeable under blast conditions.

14. A blast attenuating container as claimed in claim 11, wherein the layers of impact resistant material (35, 36, 37) and/or reinforcing sheet material (40, 41) where incorporated meet at their edges adjoining said joint means to facilitate attachment thereof to said joint means.

15. A blast attenuating container as claimed in claim 1 wherein the joint means (100) are attached to the adjoining panels (106) by mechanical fastening means (107) and/or adhesive bonding.

16. A blast attenuating container as claimed in claim 1 further reinforced externally by a lattice of straps (6) of high tensile strength.

17. A joint (100) for use in joining panels (106) of a blast attenuating container, characterised in that the joint comprises a material or has a component (103, 104) which has sufficient stiffness to provide a relatively rigid joint between the panels under normal handling conditions but which is adapted to rupture, fracture or deform under blast conditions such that the joint provides a relatively flexible hinged joint capable of transmitting tensile loads between the panels (106).

* * * * *